United States Patent [19]

Kasiewicz

[11] 4,090,480

[45] May 23, 1978

[54] ELECTRICAL OVERSPEED CONTROL FOR AN ENGINE

[76] Inventor: Stanley J. Kasiewicz, 29852 Springhill Dr., Southfield, Mich. 48076

[21] Appl. No.: 793,475

[22] Filed: May 3, 1977

[51] Int. Cl.[2] ..... F02D 11/10

[52] U.S. Cl. ..... 123/102; 123/148 S

[58] Field of Search ..... 123/102, 148 S, 198 DC, 123/117 D, 198 DB, 198 D

[56] References Cited

U.S. PATENT DOCUMENTS

| | | | |
|---|---|---|---|
| 3,534,719 | 10/1970 | Minks | 123/102 |
| 3,547,216 | 12/1970 | Marie | 123/102 |
| 3,700,996 | 10/1972 | Gutting | 123/102 |
| 3,828,742 | 8/1974 | Weis | 123/148 S |
| 3,916,865 | 11/1975 | Kiencke et al. | 123/198 DB |
| 3,941,202 | 3/1976 | Sorkin | 123/102 |
| 3,967,604 | 7/1976 | Kondo | 123/102 |
| 4,018,202 | 4/1977 | Gartner | 123/117 D |

*Primary Examiner*—Charles J. Myhre
*Assistant Examiner*—R. A. Nelli
*Attorney, Agent, or Firm*—Reising, Ethington, Barnard, Perry & Brooks

[57] ABSTRACT

An electrical control system is disclosed for preventing the speed of an engine from exceeding a predetermined value. The control system includes a reversible motor suitably connected to a throttle control of the engine and further includes motor control circuitry connected to receive an input corresponding to the speed of the engine. When the speed of the engine is below the predetermined value, the control circuitry provides for the operation of the motor in one direction. When the speed of the engine exceeds the predetermined value, the control circuitry provides for the reverse operation of the motor actuating the throttle control to limit the engine speed to the predetermined value.

6 Claims, 1 Drawing Figure

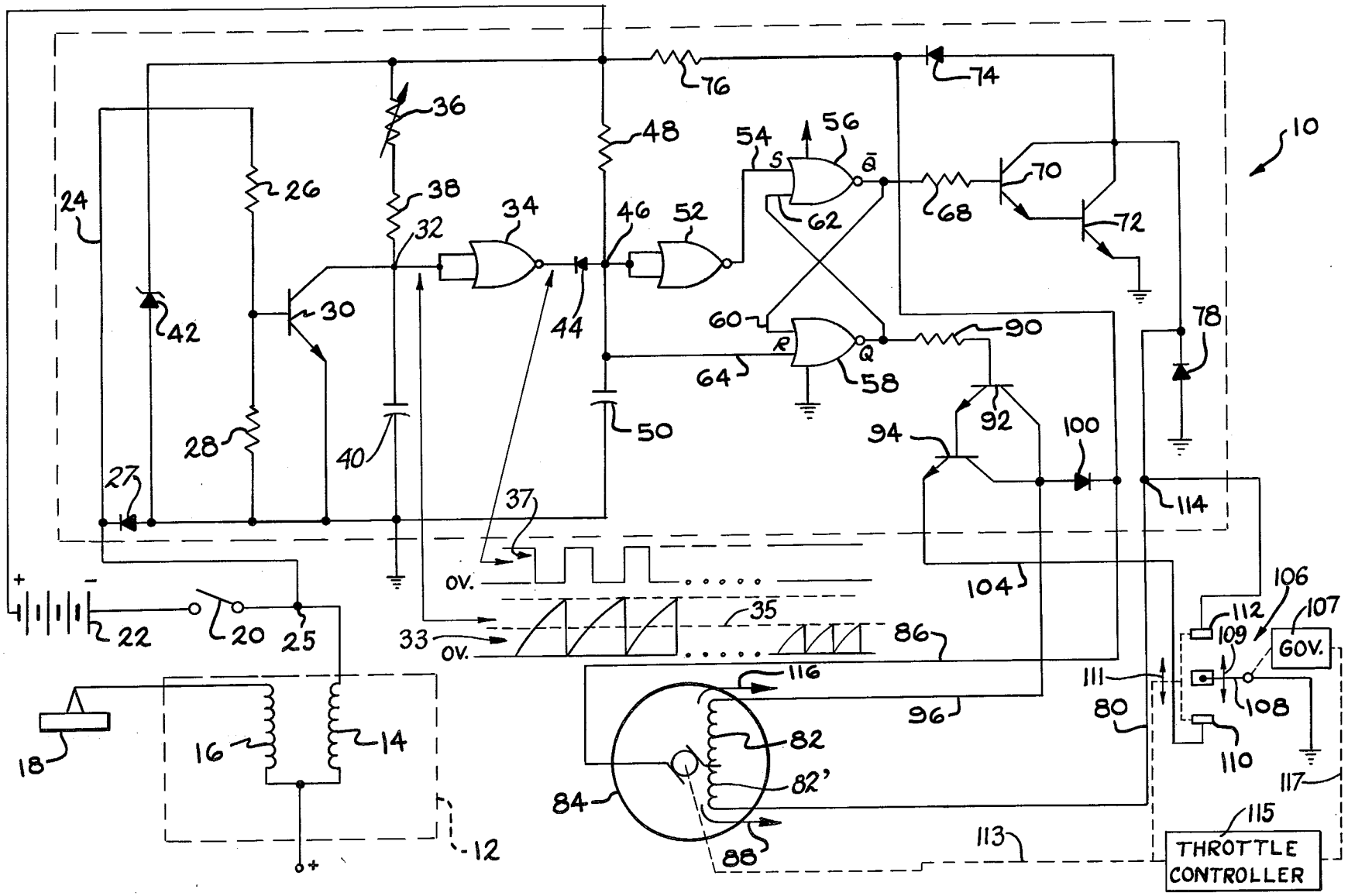
THROTTLE CONTROLLER
GOV.
0V.
0V.

ELECTRICAL OVERSPEED CONTROL FOR AN ENGINE

The present invention relates generally to engine control systems, and more particularly, to an electrical control system which is operable to prevent engine overspeed. Excessive engine speed can cause irreparable damage to the engine, and various methods have been devised to limit the upper speed at which the engine can operate. There is a need for an improved electrical control system which is quickly responsive to a signal representing the engine speed for preventing the speed of the engine from exceeding the predetermined value.

In accordance with the present invention, an electrical control system is provided for an engine such as an internal combustion engine used in conventional vehicles. The control system includes control circuitry which receives a signal corresponding to the speed of the engine and in response to the engine speed signal, the control circuitry reversibly energizes a motor which activates speed control means for preventing the engine speed from exceeding a predetermined value.

In the illustrated embodiment, the engine speed signal is derived from the ignition coil of the engine. The control circuitry is connected to an electric motor which is suitably connected to a throttle control for the engine. When the engine is operating at a speed below the predetermined value, the control circuitry provides for energizing the motor for rotation in one direction. On the other hand, if the speed of the engine exceeds the predetermined value, the control circuitry provides for energizing the motor for rotation in the other direction to activate the throttle control and reduce the engine speed to the predetermined value.

The control circuitry comprises a speed signal circuit which produces a digital signal which signifies whether the engine is above or below the predetermined value. This is preferably accomplished with a pulse controlled capacitor charging circuit responsive to ignition pulses for developing an analog signal corresponding to engine speed which is applied to an analog to digital converter. The output of the analog to digital converter is connected directly to one input of a flip-flop and is also connected through an inverter to the other input of the flip-flop. The outputs of the flip-flop are connected respectively to a pair of power amplifiers which are in turn connected to the electric motor. When one of the power amplifiers is turned on, the motor is energized to operate in one direction. When the other amplifier is turned on, the motor is energized to run in the opposite direction.

Further features and advantages of the invention will become apparent from a consideration of the following description along with the accompanying drawing in which the single FIGURE is a schematic drawing of the control system of the present invention.

Referring to the drawing, the electrical control system, indicated generally at 10, is adapted to be used on vehicles such as a truck to prevent the engine from operating at a speed above a predetermined value. The engine (not shown) is provided with an ignition coil 12 having a primary winding 14 and a secondary winding 16 which is connected to a distributor 18. The ignition circuit includes breaker points 20 connected between the vehicle battery 22 and the primary coil 14. The pulses from the primary coil are used to develop a signal having a value corresponding to engine speed.

The speed signal is developed by a pulse controlled capacitor charging circuit which comprises a storage capacitor 40 and a switching transistor 30. Ignition pulses are derived from the primary coil 14 at a junction 25 and are applied across resistors 26 and 28 which together form a voltage divider. A diode 27 is connected between the junction 25 and ground to bypass the negative swing of the ignition voltage which might cause false switching of the transistor 30. The base of transistor 30 is connected to the junction between the resistors 26 and 28 and the emitter is connected to ground. The collector to emitter circuit of the transistor is connected across the storage capacitor 40 and comprises a discharge circuit which has a very low time constant which provides substantially instantaneous discharge of the capacitor when the transistor is turned on. A charging circuit for the capacitor 40 includes a variable resistor 36 and a fixed resistor 38 in series with the capacitor across the voltage source and a Zener diode 42. The capacitor 40 is charged from the voltage source 22 through the resistors 36 and 38 with the voltage being limited by the Zener diode 42. The capacitor 40 is discharged completely each time the transistor 30 is turned on and it is charged to a certain extent each time it is turned off. Each pulse from the ignition coil 12 switches the transistor and the extent of charging of the capacitor depends upon the pulse frequency. This is shown by the waveform 33 of FIG. 1*a* in which the first three pulses represent low speed and the last three pulses represent a higher speed.

An analog to digital converter is provided in the form of a level detector which comprises an inverter 34. The inverter input is connected to junction 32 across the capacitor 40 and is adapted to switch from one state to the other at a certain threshold voltage 35. With the engine operating at a speed below the predetermined value, the peak voltage across the capacitor 40 will rise above the threshold value of the inverter 34 and, during this interval, its output will be low. When the capacitor voltage is below the threshold the output of inverter 34 is high. When the engine speed is above the predetermined value, the voltage across capacitor 40 never rises above the threshold value and the output of the inverter 34 is continuously low. Adjustment of the variable resistor 36 changes the predetermined value of the engine speed which will cause the inverter 34 to change the state of its output. The output of the inverter 34 has a waveform 37 as depicted in FIG. 1*a*. It is used to develop a speed logic signal at a junction 46, as described below.

The control system includes a logic circuit connected with the output of the level detector or inverter 34. This logic circuit comprises an RS flip-flop or latch which is suitably comprises of cross-coupled NOR gates 56 and 58. The set input S of the flip-flop receives the speed logic signal from the inverter 34 through an inverter 52, whereas the reset input R receives the speed logic signal directly from the inverter 34. The Q output is applied to the input of a power stage including transistors 92 and 94 which energize the reverse or counterclockwise winding 82 of a motor 84. The $\overline{Q}$ output of the flip-flop controls a power stage including transistors 70 and 72 which energize the forward or clockwise winding 82' of the motor.

Referring now to the logic circuit in detail, the output of the inverter 34 is connected to a time constant coupling circuit which includes a resistor 48 and a capacitor 50 for developing the speed logic signal. The resistor 48 and capacitor 50 are connected in series across the voltage source 22 and provide a time delay in the switching of the inverter 52 from one state to the other. This prevents instability or oscillation in the switching of the motor winding. Preferably the time constant of the charging circuit of capacitor 50 is about ten times that of resistors 36 and 38 with capacitor 40 and, for example, is about one-half second. A discharging circuit for the capacitor 50 extends through diode 44 to the output of the inverter 34 and thence to ground through the internal path of the inverter. The discharge circuit has a very low time constant providing substantially instantaneous discharge when the output of the inverter is low. When the peak value of the waveform 33 exceeds the threshold value 35, the voltage across the capacitor 50 is continuously below the low logic level.

The input of the inverter 52 is connected to the junction 46 between resistor 48 and capacitor 50. The output of the inverter 52 is connected to the input 54 of the NOR gate 56 in the flip-flop circuit. The output of the NOR gate 56 is applied to one input 60 of the NOR gate 58 which has its output applied to the other input 62 of the NOR gate 56. The other input 64 of the NOR gate 58 is connected to the junction point 46.

The output of the NOR gate 56 is also applied through a resistor 68 to the input of an amplifier including the pair of transistors 70 and 72 arranged in a Darlington configuration. The output of the NOR gate 56 is applied to the base of the transistor 70 which has its collector connected to the collector of the transistor 72. The emitter of the transistor 70 is connected to the base of the transistor 72 which has its emitter connected to ground. The collectors of the transistor 70 and 72 are connected through a line 80 to the forward (clockwise) winding 82' of the reversible electric motor 84. The motor 84 is connected to the power source 22 through a voltage supply line 86. Accordingly, when the transistors 70 and 72 are turned on, current flows into the motor 84 through the supply line 86, through the winding 82' in the direction indicated by the arrow 88, and to ground through the line 80 and the transistors 70 and 72. This causes the motor to run in the clockwise direction. A diode 78 is connected between the collector of transistor 72 and ground to protect the transistors against negative voltage spikes which result from switching the motor winding. A free-wheeling diode 74 is connected between the collector of transistor 72 and the supply voltage line 86.

The output of the NOR gate 58 is connected through a resistor 90 to the input of another amplifier in the form of a pair of transistors 92 and 94, also arranged in a Darlington configuration. The output of the NOR gate 58 is applied to the base of the transistor 92 which has its emitter connected to the base of the transistor 94. The collectors of the transistors are connected through a line 96 to the reverse (counterclockwise) winding 82 of the motor 84. A freewheeling diode 100 is connected between the collector of transistor 94 and the supply voltage line 86. The emitter of the transistor 94 is connected through a line 104 to a switch 106 which is in circuit with the reverse winding 82 of the motor.

The switch 106 is part of a speed governing device which, per se, forms no part of the present invention. The switch comprises a center contact 108 which is movable over a limited range of distance in the direction indicated by the arrow 109. The movement of the contact 108 is caused by a flyball governor 107 responsive to vehicle speed. The switch 106 also comprises a pair of movable contacts 110 and 112 which are movable concurrently in the direction indicated by the arrow 111. The contacts 110 and 112 are moved by the motor 84 through a suitable control linkage 113. A throttle controller 115 is connected to the linkage 113 and is also connected to the governor 107 through a linkage 117. The range of movement of the contacts 110 and 112 is somewhat greater than the range of movement of the center contact 108 so that under certain operating conditions the contact 108 is not closed against either contact 110 or 112. When the motor 84 is energized for clockwise rotation, the contacts 110 and 112 are moved in the upward direction and this movement of the throttle control linkage 113 causes the throttle controller 115 to actuate the throttle toward the closed position. When the motor is energized for counterclockwise rotation the movable contacts 110 and 112 are moved downwardly and the throttle control linkage 113 is actuated in a direction which causes the throttle controller 115 to enable increased opening of the throttle.

As noted above, the motor 84 is energized for rotation in the clockwise direction when the transistors 70 and 72 are turned on. This clockwise energization of the motor is independent of the switch 106. However, the motor may also be energized for clockwise rotation, with transistors 70 and 72 turned off, by closure of contact 108 against contact 112 under control of governor 107. The energization of the counterclockwise winding 82 of the motor is dependent upon the switch 106 and the transistors 92 and 94. When the switch contacts 108 and 110 are closed and the transistors 92 and 94 are turned on a circuit is completed from the voltage source through the supply line 86 to the counterclockwise winding 82 and thence through the transistors 92 and 94 to the switch contacts 108 and 110 to ground.

With the engine operating at a speed less than the predetermined value, the voltage at the input of inverter 52 and the input 64 of NOR gate 58 will be continuously below the low logic level. Consequently, the output of the NOR gate 56 will be low and the output of the NOR gate 58 will be high, turning on the transistors 92 and 94. The motor 84 remains off, however, if the contacts 110 and 108 are open. If the contact 108 is closed against the contact 110, the reverse winding 82 of the motor is energized. Thus the motor 84 is energized to operate in the counterclockwise direction and the throttle controller 115 is actuated in a direction which enables the throttle to be opened further.

As the speed of the engine is increased above the predetermined value, the input to the inverting gate 52 and to the input 64 of the NOR gate 58 will be continuously above the high logic level. The output of the inverting gate 52 will be low, the output of the NOR gate 56 will be high and the output of the NOR gate 58 will be low. With the output of the NOR gate 56 high, the transistors 70 and 72 will be turned on and forward winding 82' of the motor 84 will be energized and the motor will rotate in the clockwise direction. The clockwise operation of the motor 84 actuates the throttle controller 115 in a direction which causes closing of the throttle to reduce the speed of the engine below the predetermined value.

From the above description, it can be seen that an improved speed control system is provided for preventing the speed of the engine from exceeding a predetermined value.

A preferred form of the invention has been disclosed. The invention is not to be limited by the specific structure shown, but rather, it is limited only by the following claims.

The embodiments of the present invention in which an exclusive property or privilege is claimed are defined as follows:

1. An overspeed control system for an internal combustion engine having an ignition circuit and throttle control means, said control system including a reversible electric motor adapted to be connected with said throttle control means, a speed signal circuit adapted to be connected with said ignition circuit for developing an analog voltage corresponding to engine speed, a level detector connected with said speed signal circuit for developing a speed logic signal having one logic state when the engine speed exceeds a predetermined value and another logic state when the engine speed is less than said predetermined value, a flip-flop having first and second inputs and first and second outputs, said first output being at logical high when said first input is at logical high and said second output being at logical high when said second input is at logical high, an inverter having its input connected with the output of the level detector and having its output connected with the first input of the flip-flop, the output of said level detector also being connected with the second input of the flip-flop, said reversible motor having a forward winding and a reverse winding, a first power transistor coupled between the first output of said flip-flop and one of said windings and a second power transistor coupled between the second output of said flip-flop and the other of said windings, whereby said windings are selectively energized one at a time in accordance with the logic state of the output of said level detector.

2. The invention as defined in claim 1 wherein said flip-flop is an RS flip-flop.

3. The invention as defined in claim 1 wherein said ignition circuit includes an ignition coil having primary and secondary windings, and said speed signal circuit comprises a storage capacitor, a charging circuit for said storage capacitor including a resistor in series with the storage capacitor, and a discharging circuit for said storage capacitor including a transistor having its output circuit connected across the storage capacitor and its input circuit adapted to be connected with the primary winding of said ignition coil.

4. The invention as defined in claim 3 including a time constant circuit connected between the output of said level detector and the input of said inverter and also connected between the output of said level detector and the second input of said flip-flop.

5. The invention as defined in claim 3 including a resistor and a time delay capacitor connected in series as a charging circuit for the time delay capacitor, said charging circuit being adapted to be connected across a voltage source, the output of said level detector being connected to the junction of said resistor and said time delay capacitor and including a discharging circuit for the time delay capacitor, the input of said inverter and the second input of said flip-flop being connected with said junction.

6. The invention as defined in claim 5 wherein said discharging circuit for the storage capacitor has a time constant small enough to completely discharge the storage capacitor in response to each ignition pulse and wherein the discharging circuit for the time delay capacitor has a time constant small enough to completely discharge the time delay capacitor each time the storage capacitor is charged to a voltage above the threshold voltage of the level detector.

* * * * *